US005260746A

United States Patent [19]

Yoshida et al.

[11] Patent Number: 5,260,746

[45] Date of Patent: Nov. 9, 1993

[54] IMAGING FORMING APPARATUS USING POLYMERIC TONER PARTICLES

[75] Inventors: Minoru Yoshida; Kouji Hirano, both of Kanagawa, Japan

[73] Assignee: Kabushiki Kaisha Toshiba, Kawasaki, Japan

[21] Appl. No.: 623,492

[22] Filed: Dec. 7, 1990

[30] Foreign Application Priority Data

Dec. 8, 1989 [JP] Japan ..... 1-317846

[51] Int. Cl.[5] ..... G03G 15/06

[52] U.S. Cl. ..... 355/245; 355/246; 355/277; 430/48; 430/111

[58] Field of Search ..... 355/77, 245, 277, 246, 355/271; 430/32, 111, 109, 901, 904, 48, 120

[56] References Cited

U.S. PATENT DOCUMENTS 3,848,204 11/1974 Draugelis et al. ..... 355/277
4,114,536 9/1978 Kaneko et al. ..... 355/277
4,833,059 5/1989 Tomura et al. ..... 430/120
4,957,840 9/1990 Sakashita et al. ..... 430/109 X
4,999,272 3/1991 Tanikawa et al. ..... 430/111 X
5,038,178 8/1991 Hosoya et al. ..... 355/277

*Primary Examiner*—A. T. Grimley
*Assistant Examiner*—Sandra L. Brasé
*Attorney, Agent, or Firm*—Foley & Lardner

[57] ABSTRACT

An image forming apparatus having an image forming section for forming a latent image on an image bearing drum, a toner supply station for supplying a developing agent, which includes polymeric toner particles having an average particle size falling within a range of about 3-10 μm, an image bearing drum to form a developed image corresponding to the latent image on the image bearing drum and a transfer roller for transferring the developed image onto a recording medium by pressing the recording medium onto the developed image.

2 Claims, 4 Drawing Sheets

IMAGING FORMING APPARATUS USING POLYMERIC TONER PARTICLES

BACKGROUND OF THE INVENTION

1. Field of the Invention

The present invention relates to an image forming apparatus, and more particularly to apparatus for transferring electrostatic toner images to plain sheets and the like.

2. Description of the Prior Art

There has been much development any many practical applications of image forming apparatuses, such as electrostatic copying machines. An image forming apparatus initially requires the formation of a latent electrostatic image, typically by electrographic or electrophotographic means, on a photosensitive member, such as a image drum. The latent electrostatic image on the photosensitive member is subsequently developed, i.e., toned using toner particles.

In the usual case, the toned image (referred to as toner image hereinafter) may be transferred to an image receptor such as a plain paper sheet.

Various toner image transfer methods are known in the prior art. The transfer may typically be accomplished electrostatically, by means of a charge of opposite polarity to the charge on the toner particles, the former charge being used to draw the toner particles off the image drum and onto the image receptor.

The toner image transferred onto the image receptor is subsequently fused or fixed to provide enhanced durability of the toner image.

Residual toner particles which remain on the image drum during the transferring step may be cleaned off by means of a cleaning member. Further, residual charge on the image drum is removed by means of a discharging member such as a charge removing lamp, for ensuring the next formation of latent electrostatic image.

A problem typically encountered in transferring a toner image by means of the electrostatic method is the efficiency of transferring the toner image onto the image receptor. Roughly speaking, there are two types of toner particles, one made by mechanically milling a compound to fine particles and the other made by chemically dispersing a polymerized compound to fine particles. Comparing the methods, the milling method has an advantage in the cost for manufacturing. Thus, toner made by the milling method has been overwhelmingly used for electrostatic copying machines.

Recently, it has been desired to improve the quality of copies, i.e., the images produced on an image receptor. Thus, the inventor carried out tests on toners with different particle sizes, all of which were made by the milling method.

SUMMARY OF THE INVENTION

It is an object of the present invention to provide an image forming apparatus able to improve the gradation reproducibility of images.

It is another object of the present invention to provide an image forming apparatus able to improve the transfer efficiency of images.

In order to achieve the above objects, an image forming apparatus according to one aspect of the present invention includes an image forming section for forming a latent image on an image bearing drum, a toner supply station for supplying a development agent, which includes polymeric toner particles having an average particle size within a range of about 3–10 μm, an image bearing drum forming developed image corresponding to the latent image on the image bearing drum and a transfer roller for transferring the developed image onto a recording medium by pressing the recording medium on the developed image.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
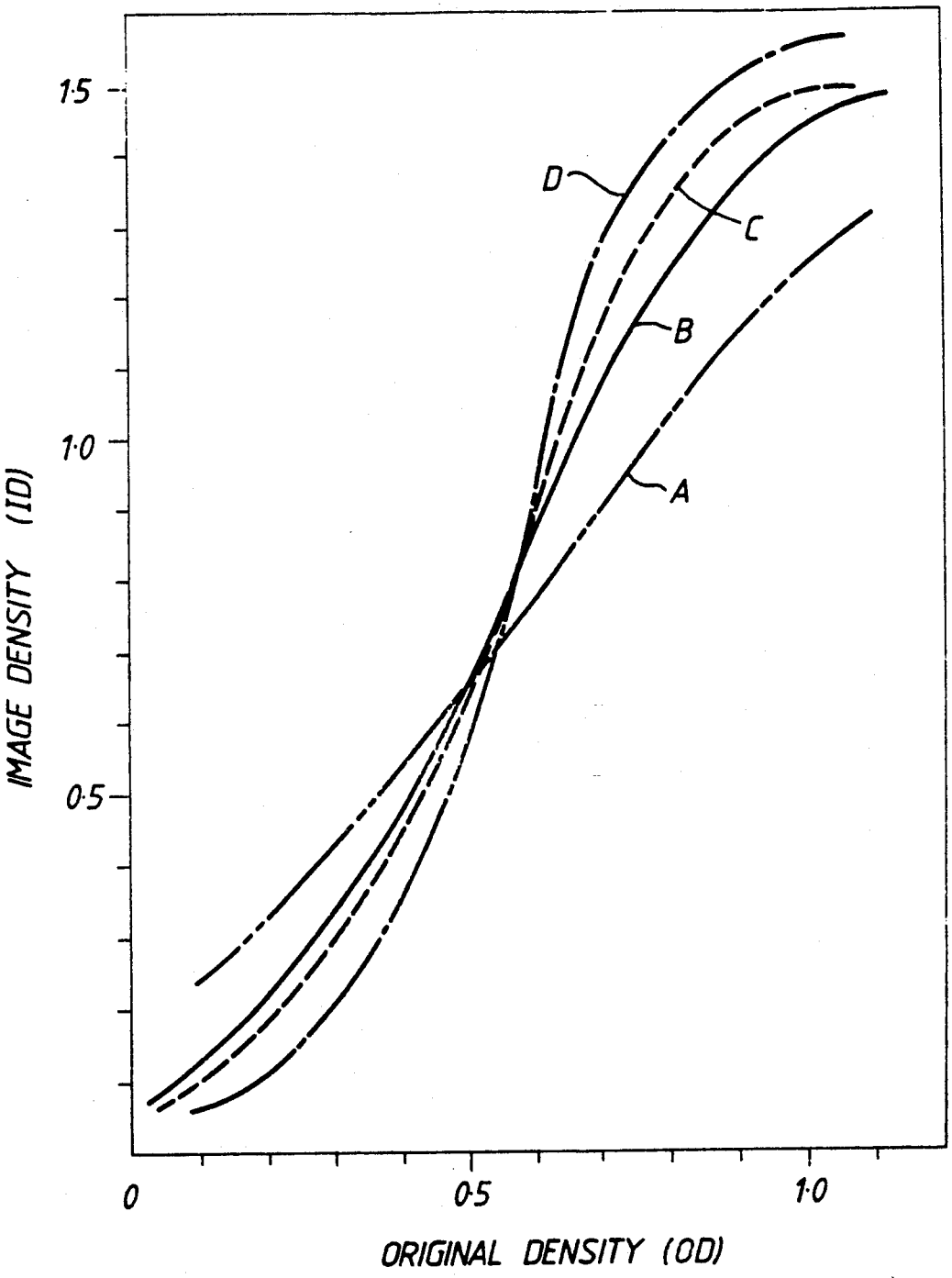
FIG. 1 is a graph showing the gradation reproducibility characteristics of copied images obtained in tests on toners with different particle sizes.

The present invention will be described in detail with reference to the FIGS. 1 through 6. Throughout the drawings, like or equivalent reference numerals or letters will be used to designate like or equivalent elements for simplicity of explanation.

Referring to FIG. 1, the present invention will be described. FIG. 1 shows the gradation reproducibility characteristics of copied images obtained in the test. The gradation reproducibility is given by image density relations between originals and copies are measured for toners with different particle sizes. In FIG. 1, Graphs A through D are plots of such relations for toner particles with the average sizes of 5 μm, 7 μm, 9 μm and 11 μm, respectively. The x-coordinate of FIG. 1 represents the image density of originals (i.e., original density referred to as OD), while the y-coordinate of FIG. 1 represents the image density of originals (i.e., original density referred to as OD), while the y-coordinate represents the image density of copies (i.e., image density referred to as ID).

As shown in FIG. 1, the toners with smaller size particles improve the gradation reproducibility of the copies images.

TABLE 1, as show below, indicates data obtained in resolution tests of copied images on those particle sizes of toner. These resolution tests were carried out by inspecting both toner images on an image drum and transferred images on image receptors in reference to standard resolution test-charts with an image density of about 0.8. In TABLE 1, the unit [Line Pair/mm] means number of sets of line pairs per unit length, i.e., 1 mm.

TABLE 1

| TONER PARTICLE SIZE | RESOLUTION ON IMAGE DRUM | | RESOLUTION ON IMAGE RECEPTOR | | TRANSFER EFFICIENCY (ID0.8) |
|---|---|---|---|---|---|
| | CIRCULAR DIRECTION | AXIAL DIRECTION | CIRCULAR DIRECTION | AXIAL DIRECTION | |
| 11 μm | 7 l p/mm | 6 l p/mm | 6.5 l p/mm | 5.5 l p/mm | 88% |
| 9 μm | 8 l p/mm | 7 l p/mm | 7 l p/mm | 6.0 l p/mm | 80% |
| 7 μm | 9 l p/mm | 8.5 l p/mm | 7.5 l p/mm | 7 l p/mm | 74% |
| 5 μm | 9 l p/mm | 9 l p/mm | 7.6 l p/mm | 7.6 l p/mm | 65% |

As shown in TABLE 1, it was revealed that the toners with smaller size particles improve resolution of the toner image on the image drum, but resolution of the image transferred onto the image receptors is inferior to that on the image drum (see the data of Transfer Efficiency in the table). Such a reduction of the transfer efficiency is due to the toner particles with smaller size easily scattering in the course of image transfer from the image drum to the image receptors.

As a result of the tests, it is recognized that toners with smaller particle size improve the gradation reproducibility of images, but at the same time lower the transfer efficiency of images.

Figure 2:
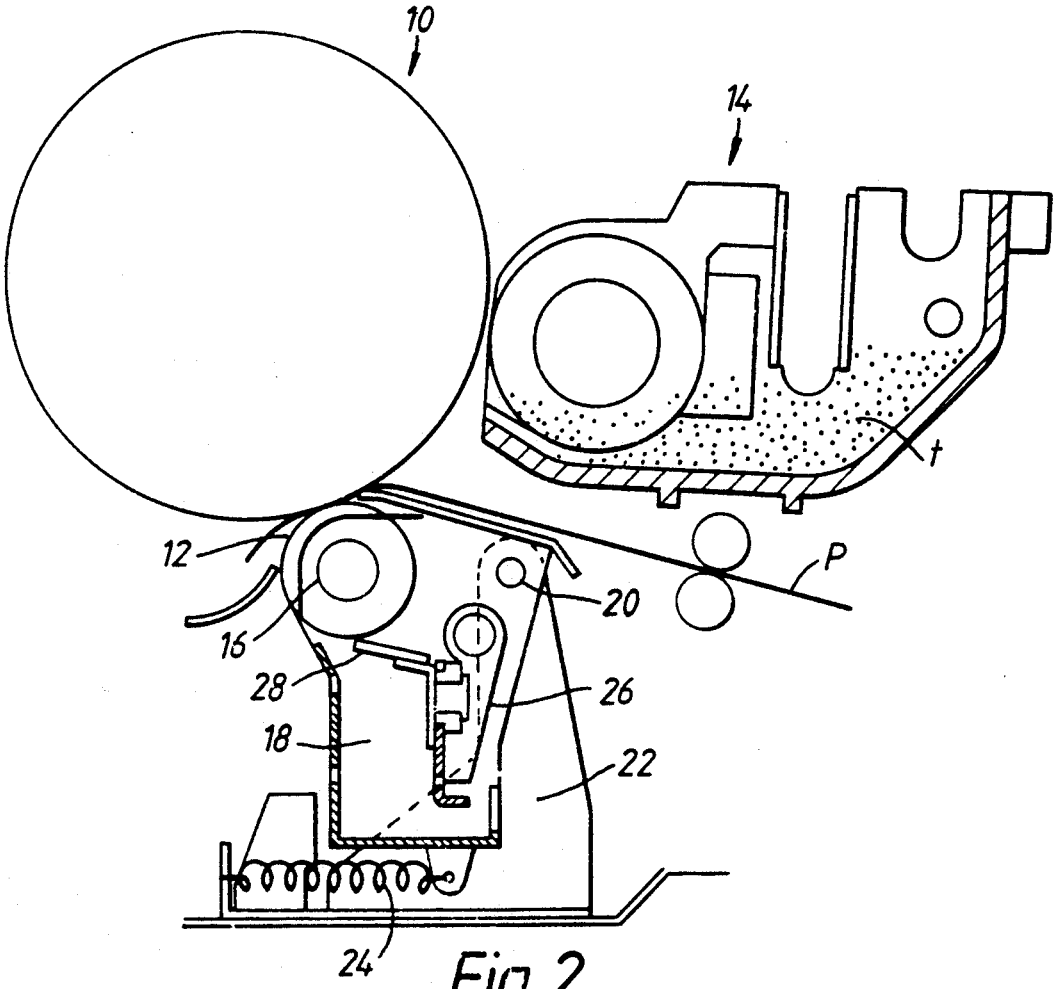
FIG. 2 is a schematic cross section of an embodiment of image forming apparatus according to the present invention.

FIG. 2 is a schematic cross section of an embodiment of image forming apparatus according to the present invention. As shown in FIG. 2, the image forming apparatus includes an image drum 10 on which a latent electrostatic image is formed and thereafter developed by toner, and a transfer member such as a roller 12 (referred to as image transfer roller hereinafter) disposed in rolling contact with the image drum 10.

The latent electrostatic image is formed on the image drum 10 with a well-known manner of applying an optical image of document, etc. The latent electrostatic image is then developed by toners at a toner supply station 14. That is, the toner supply station 14 supplies toner particles t stored therein, so that a toner image is developed on the image drum 10 in accordance with the latent electrostatic image.

The toner image is then transferred onto an image receptor P, typically a paper sheet fed between the image drum 10 and the transfer roller 12 in order to receive the toner image from the image drum 10. The development of a toner image, i.e., the image transfer, is established by means of pressure at the point of contact between the image drum 10 and the transfer roller 12.

The transfer roller 12 is rotatably supported on a shaft 16 so that the transfer roller 12 is driven in contact with the image drum 10. The shaft 16 is supported on a support member 18 which is rockably mounted with a pin 20 on a chassis 22 of the image forming apparatus. While the support member 18 is mechanically biased by a biasing member such as a spring 24, thus the transfer roller 12 is pressed against the surface of image drum 10.

The support member 18 is also provided with a cleaner 26, which is also rockably mounted on the support member 18 and biased to the transfer roller 12. The cleaner 26 includes a cleaning blade 28 for scraping off toner particles that stick to the transfer roller 12. The support member 18 also serves to store the toner particles scraped off from the transfer roller 12.

The shaft 16 of the transfer roller 12 is charged with an electrical charge with a positive polarity (referred to as a transfer bias hereafter) for attracting toner particles which forming the toner image. Thus, the toner image is transferred from the image drum 10 to the paper sheet P.

The transfer bias is preferably set between 1200 V to 2200 V. The inventor found that a transfer bias lower than 1200 V causes a poor image transfer, while the transfer bias higher than 2200 V damages the transferred image on the paper sheep P by electrical leakages. The transfer bias shifts to a lower potential in an image transfer system using a reversal process.

Figure 3:
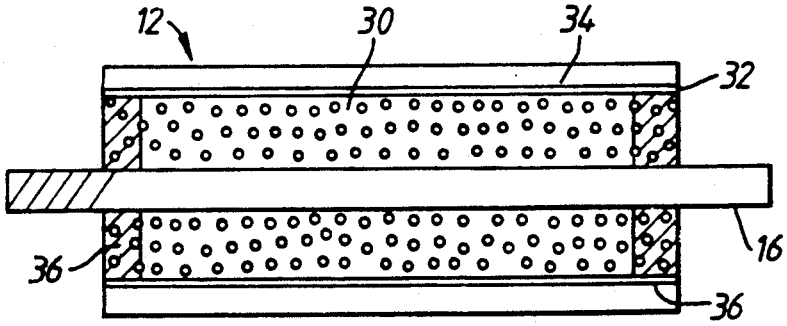
FIG. 3 is a section showing the transfer roller of FIG. 2.

Referring now to FIG. 3, the transfer roller 12 comprises a metal shaft 16, a resilient layer 30 surrounding the shaft 16, a conductive layer 32 covering the resilient layer 30, a resistive layer 34 coated on the conductive layer 32 and a pair of conductive end covers 36, 36 terminating both ends of the resilient layer 30.

The resistive layer 34 can be made of rubber or plastics such as polyester, polyethylene and vinyl chloride, which is made conductive by agents such as carbon powder, copper powder and nickel powder distributed through the layer. The resistive layer 34 can be also made of a conductive polymer. The resistive layer 34 preferably has a volume resistivity between $10^6$ Ω·cm to $10^{25}$ Ω·cm, in particular between $10^{13}$ Ω·cm to $10^{23}$ Ω·cm. The value of the volume resistivity can be easily managed by the amount of the conductive agent in the resistive layer 34.

Preferably, the volume resistivity of the resistive layer 34 hardly changes in accordance with external causes such as pressure, temperature and humidity. To the purpose the resistive layer 34 is constructed in a non-form structure.

According to the performance of the resistive layer 34 as mentioned above, the transfer roller 12 allows image receptors P with different thicknesses such as a paper sheet, a letter envelope and a postcard to be applied for the copy on it under uniform conditions.

The surface of the resistive layer 34 should be as smooth as possible, making the removal of residual toner particles on the layer 34 easy.

The resistive layer 34 should also be as thin as possible, and preferably be the thickness between 0.02 mm to 2 mm, for maintaining a suitable softness.

The conductive layer 32 can be made of polyester with conductive powder distributed therein, with a thin metal sheet or conductive agent 32 bonding the resistive layer 34 to the resilient layer 30.

The combined thickness of the resistive layer 34 and the conductive layer 32 should be one tenth or less than the thickness of the resilient layer 30, for effecting properly the resiliency of the resilient layer 30.

The resilient layer 30 can be made of foamed materials such as rubber, polyethelene or urethane, for assuring a quick deformation response by suppression against the image drum 10 and removal therefrom. To this purpose, any material with a high creep-resistivity and a high plastic deformation resistivity can be used as the resilient layer 30.

The foam structure of the resilient layer 30 can preferably be of the open-cell form because of its stability at different ambient temperatures, but it is not restricted thereto. The resiliency of the layer 30 can be adequately managed by selecting material, the foam cell structure and a foaming ratio. Typically, the resilient layer 30 has a rubber-like elasticity of 30 or less.

Conduction between the shaft 16 and the conductive layer 32 is provided by the pair of conductive end covers 36, 36.

Returning to FIG. 2, the mechanical force for pressing the transfer roller 12 against the image drum 10, as well as the elasticity of the illustrated transfer roller 12, has an important role in the image transfer process. In the embodiment, an adequate value of the pressure bias was around 60 g/cm$^2$ to 280 g/cm$^2$. The suppression bias was measured by dividing the pressure of the transfer roller 34 against the image roller 10 with a nip area between them. An adequate value of the elasticity of the transfer roller 12 was between about 10 to 60 degrees.

In the practical embodiment implemented by the inventor, the following values were used in regard to the transfer roller 12:

Transfer Bias = 1800 V;

Suppression Force = 100 g/cm$^2$; and

Rubber-like Elasticity = 30.

Copying tests with different types of toners, according to the present invention, will be described. The tests were executed on two types of toners. The first type was made by a conventional milling method, in which the fine particles are mechanically produced. The second type of toner was made by a recently developed polymerization method, in which fine particles are chemically produced.

TABLE 2 indicates data obtained in tests executed on the first type of toner. These tests were carried out in a similar manner as the tests on a conventional apparatus (see TABLE 1).

TABLE 2

| TONER PARTICLE SIZE | RESOLUTION ON IMAGE DRUM | | RESOLUTION ON IMAGE RECEPTOR | | TRANSFER EFFICIENCY (ID0.8) |
|---|---|---|---|---|---|
| | CIRCULAR DIRECTION | AXIAL DIRECTION | CIRCULAR DIRECTION | AXIAL DIRECTION | |
| 7 μm | 9 l p/mm | 8.5 l p/mm | 8.5 l p/mm | 7.5 l p/mm | 86% |
| 5 μm | 9 l p/mm | 9 l p/mm | 8.5 l p/mm | 8.5 l p/mm | 76% |
| 4 μm | 9.5 l p/mm | 9.0 l p/mm | 8.5 l p/mm | 8.5 l p/mm | 71% |
| 2.5 μm | 8.5 l p/mm | 8.5 l p/mm | 6.5 l p/mm | 6.0 l p/mm | 55% |

As sown in TABLE 2, it was revealed that toners with smaller size particles shown improved resolution of the toner image on the image receptor, in comparison to the results of tests using a conventional apparatus (see TABLE 1). Thus, transfer efficiency from the image drum to the image receptors were improved.

However, when the particle size of the first type of the toner becomes small, it was revealed that a blank-out defect occurs in solid images and line images. That is, there is a failure to properly transfer the image onto the paper. In particular, such a defect occurred conspicuously in line images with the width of 200 μm to 500 μm. The blank-out defect occurs due to an insufficiency in the fluidity of the toner. The fluidity of a toner decreases in accordance with a decrease of toner particle size.

Figure 4:
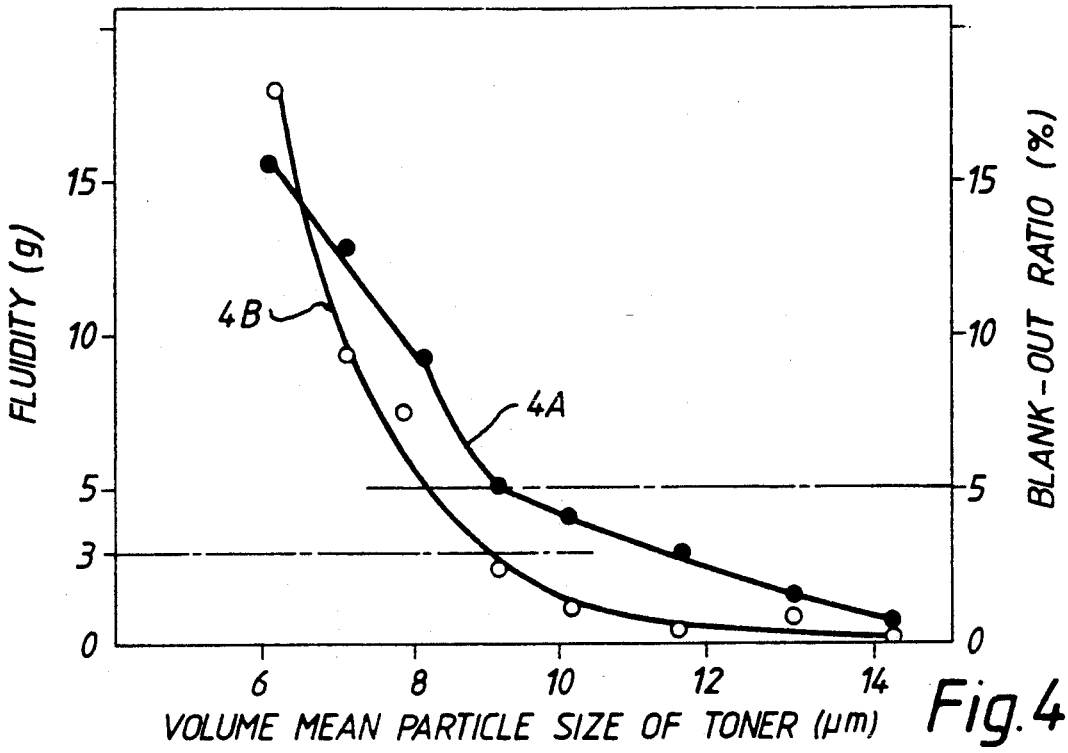
FIG. 4 is a graph showing the blank-out ratio of toner image, and further showing the fluidity of toner to the particle size of toner.

FIG. 4 is a graph showing the blank-out ratio in regard to the particle size of toners (Graph 4A), as well as the relation between the fluidity of toners and the particle size of toners (Graph 4B). In FIG. 4, the x-coordinate represents the volume mean particle size of toner, while the left and the right y-coordinates represent the blank-out ratio and the fluidity, respectively. The measurement of fluidity will be described later.

As shown in FIG. 4, both the blank-out ratio (Graph 4A) and the fluidity (Graph 4B) worsen as the particle sizes become smaller. It is observed that visible defects of images are conspicuously present when the blank-out ratio exceeds 5%.

Figure 5:
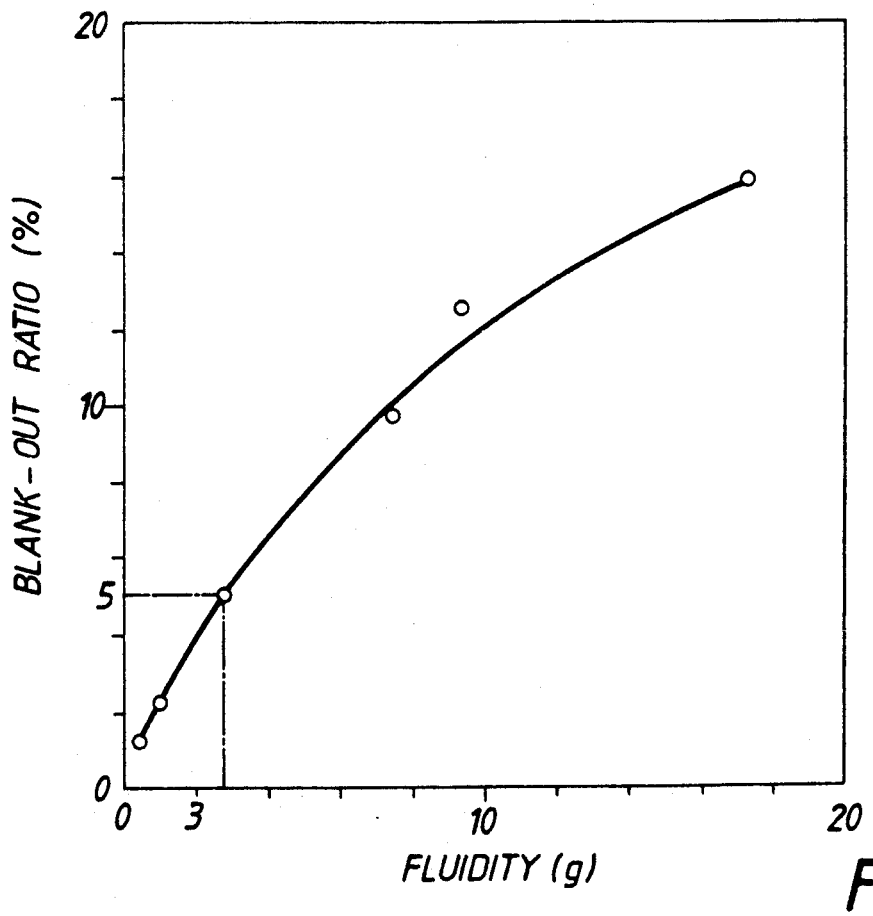
FIG. 5 is a graph showing the relation between the blank-out ratio and the fluidity of the toner made by the milling method.

FIG. 5 depicts a graph showing the relation between the blank-out ratio and the fluidity of the first type of toner, executed by using the embodiment of the present invention. The blank-out ratio was examined for line images with the width of 300 μm. As shown in FIG. 5, the blank-out ratio exceeded 5% when fluidity was larger than 3 g.

As a result of tests on the first type of toners, it is recognized that toners with smaller particle size improve the gradation reproducibility of images and the transfer efficiency of images, but the defect of blank-out in solid images and relatively thick line images occurs.

Figure 6:
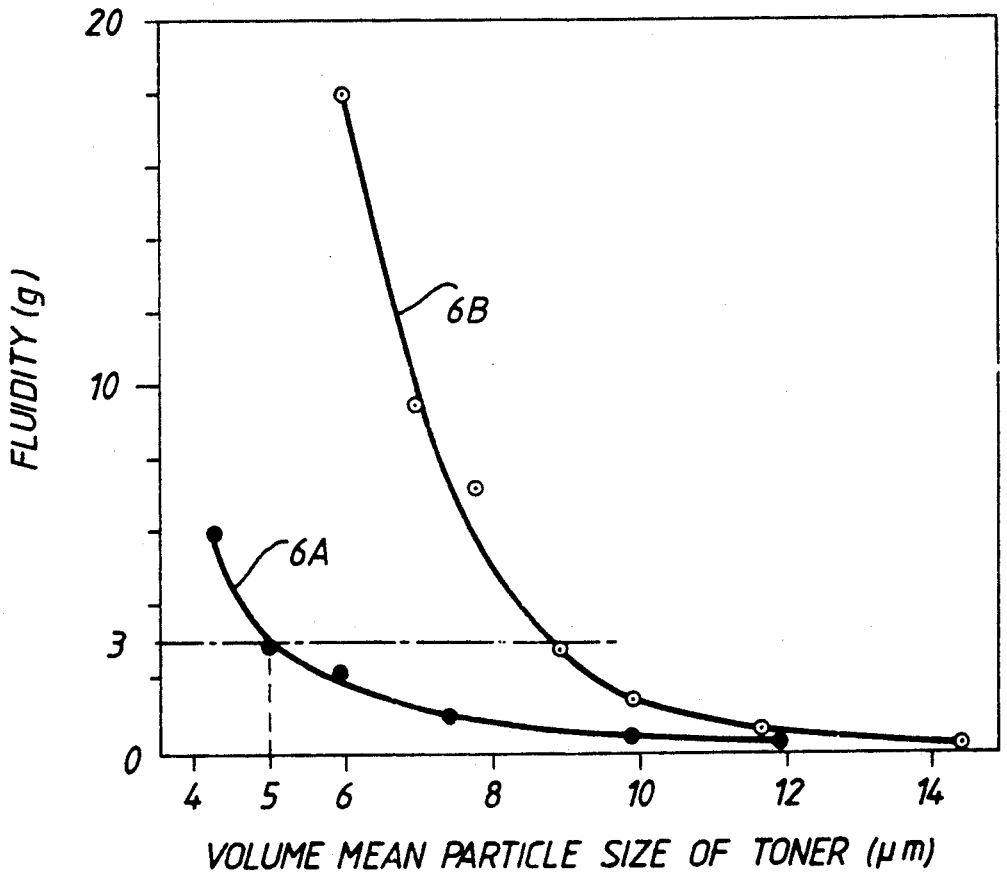
FIG. 6 is a graph showing the fluidity of toners made by the polymerization method, as well as that of toners made of the milling method, for comparison.

Referring now to FIG. 6, other tests executed on the second type of toners according to the embodiment of the present invention will be described. These tests were carried out using toners produced by the polymerization method.

FIG. 6 is a graph showing the relationship of fluidity to the particle size of the second type of toners (Graph 6A), as well as that of the first type of toners (Graph 6B), for the purpose of comparison. In FIG. 6, the x-coordinate represents the volume mean particle size of the toner, while the y-coordinate represents its fluidity.

As shown in FIG. 6, the fluidity of the second type of toners, i.e., toners made by the polymerization method (Graph 6A) is remarkably increased in comparison to the that of the first type of toners, i.e., toners made by the conventional milling method (Graph 6B).

According to this embodiment, the second type of toner, with particle sizes down to around 5 μm, present a satisfactory fluidity below 3 g, thus such a blank-out defect was scarcely observed.

The measurements of fluidity of the toners and the blank-out of images will now be described.

Measurement of Fluidity

The fluidity of toners was measured according to the following manner, by using a "Powder Tester" manufactured by HOSOKAWA MICRON Co., Ltd.

1. Shake tones in a polyethelene bottle 20 times;
2. Put toner of 200 g gently on a set of #200, #100 and #60 meshes, which are aligned in order in the vertical direction;
3. Vibrate the set of meshes for 30 sec; and
4. Measure the weight of the toner remaining on the meshes.

The total weight of the toner represents the fluidity of the toner.

Measurement of Blank-out

The blank-out of the image was measured by using a vision processor; Model "TOSPIX-II" of TOSHIBA CO., a steromicrometer; Model "SMX-010" of NIPPON KOUGAKU Co., an ITV camera; Model "CTC-2600" of IKEGAMI TSUUSHINKII Co., a lighting device; "LA-150SAE" of WATCH WORKS Co. The magnification of the objective lens used in the stereomicrometer was set at 2. The measurement of the blank-out was carried out for a line image with a width of 300 μm as follows.

1. Capture the line image by the vision processor, Model "TOSPIX-II";
2. Digitize in binary form the captured image using a threshold established at a density around 0.5;
3. Determine a blank-out area S1 in the digitized image;
4. Fill up the blank-out area in the digitized image;
5. Determine the entire area S2 of the digitized image; and
6. Calculate the blank-out ratio by $(S1/S2)\times 100\%$.

As described above, the present invention can provide an extremely preferable image forming apparatus.

While there have been illustrated and described what are at present considered to be preferred embodiments of the present invention, it will be understood by those skilled in the art that various changes and modifications may be made, and equivalents may be substituted for elements thereof without departing form the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. An image forming apparatus comprising:

means for supplying a developing agent, which includes polymeric toner particles having an average particle size falling within a range of about 3–10 μm and a fluidity below 3 g, to a rotatable image bearing member, to form a developed image;

means for transferring the developed image on the image bearing member to a recording medium, wherein the transferring means includes a resilient rotary member with a rubber-like elasticity of 10–60 degrees for pressing the recording medium against the image bearing member at a bias of around 60–280 g/cm$^2$; and means for applying a transfer bias of about 1200–2200 V between the transferring means and the image bearing means.

2. An image forming apparatus of claim 1, wherein the average size of the polymeric toner particles is greater than 5 μm.

* * * * *